United States Patent [19]

Gjerde

[11] 4,184,394

[45] Jan. 22, 1980

[54] MOTOR-DRIVEN SAW HAVING A CIRCULAR SAW BLADE

[75] Inventor: Arne Gjerde, Jevnaker, Norway

[73] Assignee: A/S Norcem, Oslo, Norway

[21] Appl. No.: 891,004

[22] Filed: Mar. 28, 1978

[30] Foreign Application Priority Data

Apr. 1, 1977 [NO] Norway ..... 771173

[51] Int. Cl.[2] ..... B27B 5/24

[52] U.S. Cl. ..... 83/477.1; 83/473; 83/477.2

[58] Field of Search ..... 83/102.1, 471.3, 471.2, 83/473, 477, 477.1, 477.2, 488

[56] References Cited

U.S. PATENT DOCUMENTS

| | | | |
|---|---|---|---|
| 2,719,547 | 10/1955 | Gjerde | 83/471.3 |
| 2,937,672 | 5/1960 | Gjerde | 83/477.1 |
| 3,280,861 | 10/1966 | Gjerde | 83/477.1 |

FOREIGN PATENT DOCUMENTS 598062 2/1948 United Kingdom .

*Primary Examiner*—J. M. Meister

*Attorney, Agent, or Firm*—Holman & Stern

[57] ABSTRACT

The specification discloses a saw having a circular saw blade wherein a motor for driving the saw blade and a bearing for the saw blade spindle are mounted on a mounting frame which is positioned below a work table and can be raised and lowered in a pivoting movement about a horizontal pivoting axis parallel to the spindle axis. The mounting frame is suspended in a tiltable cradle suspended in a circular work support which is flush with the top of the work table and is rotatably mounted in a circular opening therein. When the mounting frame is raised the saw blade will project through a slot in the support. The mounting frame is operated by a thin bar projecting through the slot in the support and carrying a handle above the work table. The bar is integral with a riving knife. It is rotatably mounted about the saw blade axis, and it is connected to the cradle by a linkage formed by an articulated rod and the mounting frame. Thereby the operating bar will maintain the same vertical position relative to the saw blade axis when lifted. In fact, it will move along a path equi-distant to the path of the saw blade axis, and the length of the movement will be the same as that of the saw blade axis.

6 Claims, 2 Drawing Figures

MOTOR-DRIVEN SAW HAVING A CIRCULAR SAW BLADE

BACKGROUND OF THE INVENTION

1. Field of the Invention

The present invention relates to a saw having a circular saw blade wherein a motor for driving the saw blade and a bearing for the saw blade spindle are mounted on a frame supported for pivotal motion about an axis perpendicular to the plane of the saw blade between an inoperative position in which the saw blade is positioned below a work table, and an operative position in which the saw blade projects through a slot in the table. In particular, the invention relates to a saw as indicated wherein the slot is provided in a circular work support rotatably mounted in the work table and the mounting frame is suspended in the work support, preferably by a cradle that is tiltable relative to the support.

2. Description of the Prior Art

Such saws have been provided with various types of operating means for raising the saw blade through the slot, all of them having a handle or a foot lever positioned below the work table. For example, the raising handle has been provided on an extension of the mounting frame. Thereby the handle will have a longer stroke than the saw blade. In all saw designs in which the operating handle is provided below the work table and between the legs thereof, it has been difficult to get hold of the handle, which rotates and tilts together with the mounting frame. From British Patent Specification No. 1 152 787 there is known an operating means which is positioned at the same side of the work table irrespective of the rotation of the saw blade and the support. In this saw structure the handle always moves vertically upwards, and when the saw blade lies in a vertical plane the length of the movement of the handle will be equal to the length of the movement of the saw blade axis. However, when the saw blade is in a tilted position the movement of the saw blade takes place in an inclined direction and will be substantially longer than the movement of the handle, which is still lifted in a vertical direction. This lack of correspondence between direction and length of the movement of the handle and the saw blade, respectively, adversely affects a precise and sensitive operation of the saw.

SUMMARY OF THE INVENTION

The invention aims at providing a motor-driven saw of the type referred to, wherein the operating means, especially the handle thereof, is provided in a position in which it is easy to operate, the movement of the handle exactly corresponding to the movement of the saw blade axis, at least in the direction of the line of fall of the saw blade plane.

This object is met in a saw as indicated above by providing a flat operating bar or plate which lies in the plane of the saw blade and is guided in such a manner as to maintain, when the saw blade is raised, a constant distance from the saw blade axis, measured in the direction of the line of fall of the saw blade plane, said bar or plate projecting through the slot in the work table and carrying a handle.

This arrangement of the operating handle leads to a better working position, since the operator of the saw may work with a straight back. The raising requires no particular force, since the mounting frame is approximately balanced about its pivotal axis. Said plate or bar must of course be flat in order to project through the narrow slot in the work table. More specifically, the operating bar should not be thicker than the saw blade and should preferably have the same thickness as a riving knife mounted on the rear side of the saw blade. The operating bar will always lie in the plane of the saw blade, since it tilts together with the saw blade.

The mounting and guiding of the operating bar in such a manner that it will maintain the desired position relative to the saw blade axis, may be effected in various ways. For example, the operating bar may be rigidly connected to a mounting arm which is mounted for pivotal movement relative to the mounting frame and the saw blade axis. The additional guide means then required in order to obtain the desired movement may be a guideway, but preferably consists of an articulated rod which is connected to the structure or member in which the mounting frame is suspended.

In its simplest form the saw of the invention is one in which the plane of the saw blade is stationary relative to the work table. The said member to which the articulated rod is connected, and in which the mounting frame is suspended, may then be the work table itself or a member rigidly secured thereto. However, in a more advanced embodiment (see for example British Patent Specification No. 718 963) of saws of the kind referred to, the mounting frame is suspended in a circular work support mounted in an opening in the work table and being rotatable about a vertical axis so that the plane of the saw blade is rotatable. The slot through which the saw blade projects is in this case of course provided in the rotatable work support. In this embodiment the said member to which the articulated rod is connected must be rotatable together with the plane of the saw blade and should therefore not be rigidly secured to the work table itself, but for example to the circular work support forming part thereof. In a still more advanced embodiment of such saws (see for example British Patent Specification No. 996 048) the mounting frame is supported on a cradle which in turn is supported for pivotal movement about an axis extending along the slot in the rotatable work support, whereby the saw blade may also be tilted relative to the work support. In this embodiment the said member will be the cradle or a member rigidly secured thereto so as to follow the tilting movement of the said blade. In all these embodiments the member to which the articulated rod is connected, is rigidly secured to or integral with the structure in which the mounting frame is suspended.

When it is desirable to provide a riving knife the flat operating bar may be rigidly connected thereto or even integral therewith, whereby the mounting and guiding means will provide the desired movement of the operating bar as well as the riving knife.

In known saws the operating means including the handle is usually used for rotation of the support. The use of the handle for this operation will subject the relatively thin, flat operating bar to bending stresses. According to a further feature of the invention the operating bar is therefore guided through a guide member which is provided subjacent the slot in the table and which is secured to and moves together with the member or structure in which the mounting frame is suspended. As discussed above, this member or structure will be the cradle in a tiltable saw, the work support in a saw having a rotatable work support, and the table in the simplest form of the saw. The guide member laterally supports the relatively thin operating bar.

Further features and advantages of the saw according to the invention will appear from the following description, reference being had to the drawings which illustrate a saw having a rotatable circular work support in the table plate as well as a cradle tiltably suspended in the work support.

DESCRIPTION OF THE PREFERRED EMBODIMENT

Figure 1:
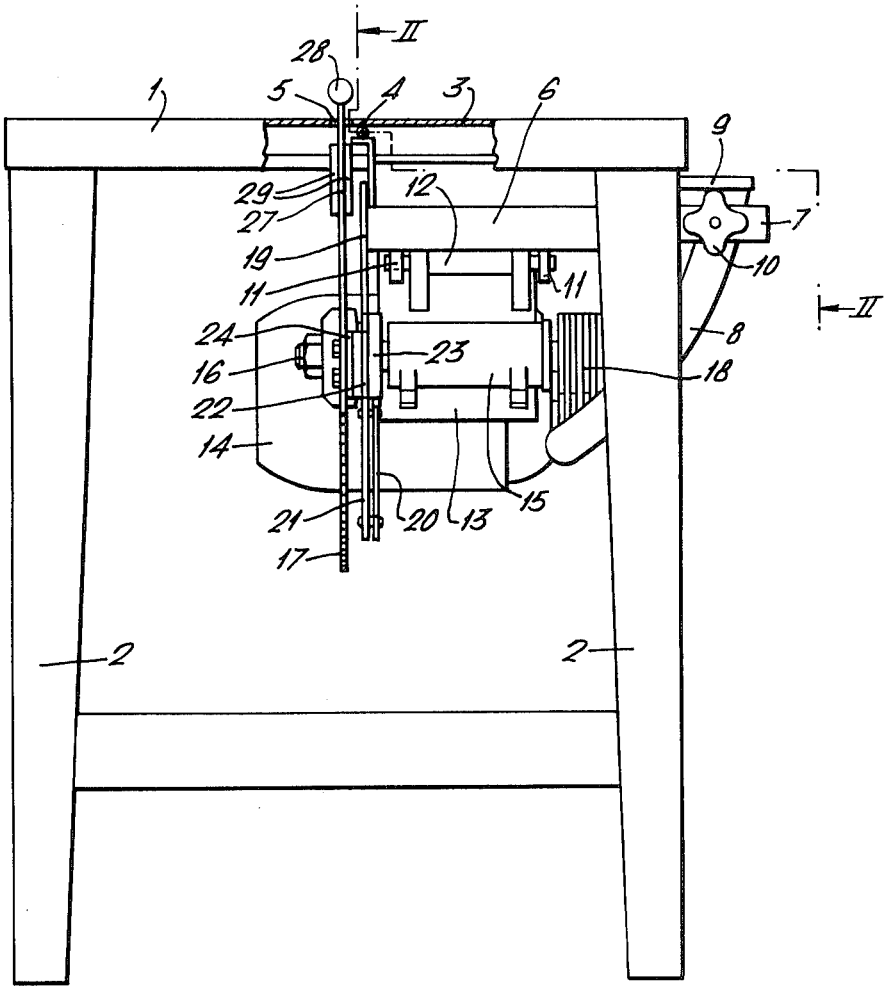
FIG. 1 shows the saw in front view, parts of the table and the support being broken away for the sake of clearness.
Figure 2:
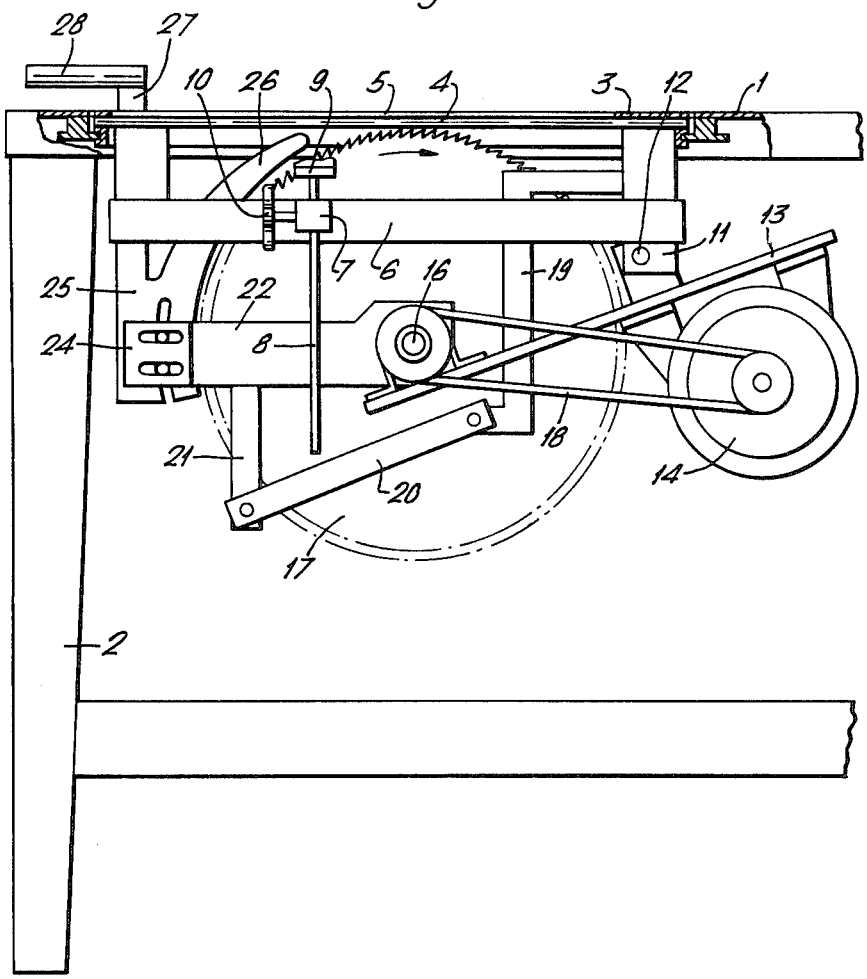
FIG. 2 is a fragmentary side view of the saw, partly in section along the line II—II in FIG. 1.

In order to simplify the illustration structures which are placed on the top of the work table for protection, as a fence for the work etc., have been omitted, since they are not relevant to the invention. The same is true for a possible guard for the part of the saw blade always positioned below the table.

In the embodiment illustrated the saw has a work table having a rectangular table plate 1 and four legs 2. The table plate 1 has a circular opening for rotatable mounting of a circular support 3 for the work. The means for rotating the support 3 and fixing the support relative to the table 1 are not shown in the drawing, since they are not relevant to the invention. On the lower side of the disc-shaped support 3 a shaft or bar 4 is rotatably mounted. The shaft or bar 4 is mounted for rotation about an axis which extends as close to a slot 5 in the support 3 as possible. However, the shaft or rod 4 must not block the slot 5. If desired, the end portions of the shaft or rod 4 may be cranked outside the end of the slot 5 to serve as journals, whereby the axis of rotation of the rod 4 may be made virtually to coincide with the slot 5. The rod 4 carries a cradle consisting of a stirrup-shaped supporting frame 6. On the outer side of the supporting frame there is mounted a narrow stirrup 7 which extends on either side of a curved rail 8 which through an arm 9 is connected to the rotatable support 3. The stirrup 7 carries a clamping screw 10 which permits the cradle consisting of the supporting frame 6 to be fixed to the rail 8.

In a pair of lugs 11 on the rear side of the supporting frame 6 there is mounted a pivot 12 for a mounting frame or plate 13, which on its lower side carries an electric motor 14 and on its upper side carries a bearing or a housing 15 for the saw blade spindle 16 to which the saw blade 17 is attached. The motor 14 is connected to the saw blade spindle 16 by a belt drive 18.

A depending bar 19 is welded to the cradle. An articulated rod 20 is pivotally mounted at one end in the bar 19 and at the other end in a rod 21 which is welded to a mounting arm 22, which by means of a boss 23 is pivotally mounted about the saw blade axis. The boss 23 may for example be mounted direct on the saw blade spindle 16 by means of ball bearings, or it may be mounted on the spindle bearing 15. The mounting arm 22 extends approximately horizontally and parallel to the saw blade 17 toward the front of the saw table and is in front of the saw blade 17 cranked to form a connecting portion 24 carrying a forked plate 25 which lies in the plane of the saw blade 17. One leg of the forked plate is of an arcuate shape and forms a riving knife 26, whereas the other leg forms an operating bar 27 which projects through the slot 5 and at its upper end carries a handle 28.

The length of the articulated rod 20 is equal to the centre distance between the pivot 12 and the saw spindle. Further, the articulated rod 20 is parallel to a line through the axis of the pivot 12 and the saw spindle 16 perpendicular to these axes. The axes of articulation at the ends of the articulated rod 20 and the axes of the saw blade spindle 16 and the pivot 12, respectively, thus form the vertices of a parallelogram. Accordingly, the articulated rod 20 and the mounting frame 13 form a linkage between the mounting arm 22 and the cradle or supporting frame 6 in which the mounting frame 13 is supported or suspended. In this manner it is ensured that any point on the mounting arm 22 and thereby the riving knife 26 and the operating bar 27 will move along equi-distant paths and cover exactly the same distance as the saw blade spindle 16 when the saw blade is raised.

To form a lateral support for the operating bar 27 a guide 29 which, for example, is constituted by a plate bent into U-shape, is provided on the cradle directly below the slot 5.

It will be seen that according to the invention there is provided a motor saw which may be operated very conveniently and precisely by an operator standing at the work table, the movements of the operating handle completely corresponding to the movements of the saw blade spindle, the handle at the same time following the rotational movement of a rotatable support and any tilting movement of a cradle. The handle 28 will never be in the way as far as the work is concerned, when the saw is correctly used. In cross cutting operations the work will extend across the saw blade and abut an adjustable fence behind the saw blade, whereas the handle 28 is positioned at the front of the saw. In ripping operations the mounting frame will be fixed, in a manner which is not shown in detail, in a position in which the saw blade projects through the slot 5 to the desired level. The handle 28 will then be well above the top of the saw blade 17.

What I claim is:

1. Table-mounted circular sawing apparatus comprising a work table structure including a table top, means defining a slot in said table top, mounting means below said table top for a circular saw, said mounting means including support means and a mounting frame pivotally connected to said support means about a pivotal axis, a circular saw blade carried by said mounting frame for rotation about a saw blade axis, said saw blade being aligned with said slot, drive means for rotating said saw blade about said saw blade axis, said mounting frame being pivotally movable about said pivotal axis between a first position in which said blade is beneath said table top and a second position in which an upper portion of said blade extends through said slot and projects above said table top, an operating bar connected with said mounting frame for moving said frame between said first and second positions, said operating bar being substantially coplanar with said saw blade and extending upwardly through said slot, an upper end of said operating bar projecting above said table top and being provided with handle means and linkage means connected between said operating bar and said support means for maintaining a fixed distance between said operating bar and said saw blade axis measured in the direction of the line of fall of the saw blade plane.

2. The apparatus of claim 1 wherein said table top comprises a circular support rotatably mounted in said work table structure.

3. The apparatus of claim 2 wherein said support means includes a cradle which can tilt relative to said circular support and said mounting frame is carried by said cradle.

4. The apparatus of claim 1 including a riving knife integral with said operating bar.

5. The apparatus of claim 1 wherein said operating bar includes a mounting arm pivoted about said saw blade axis and said linkage means comprises a first rod attached to said mounting arm and a second rod pivoted at one end to said first rod and pivoted at its other end to a member associated with said support means, the length of said second rod between its pivots being equal to the distance between said pivotal axis and said saw blade axis and said second rod being parallel to a plane containing said pivotal axis and said saw blade axis.

6. The apparatus of claim 1 including guide means below said slot for said operating bar.

* * * * *